US007143822B2

(12) United States Patent
Wisniewski

(10) Patent No.: US 7,143,822 B2
(45) Date of Patent: Dec. 5, 2006

(54) VARIABLE OIL COOLER TUBE SIZE FOR COMBO COOLER

(75) Inventor: Christopher Wisniewski, Livonia, MI (US)

(73) Assignee: Denso International America, Inc., Aouthfield, MI (US)

( * ) Notice: Subject to any disclaimer, the term of this patent is extended or adjusted under 35 U.S.C. 154(b) by 36 days.

(21) Appl. No.: 11/085,005

(22) Filed: Mar. 18, 2005

(65) Prior Publication Data

US 2006/0207754 A1 Sep. 21, 2006

(51) Int. Cl.
*F28D 7/16* (2006.01)

(52) U.S. Cl. ..... 165/140; 165/151; 165/153; 165/173

(58) Field of Classification Search ..... 165/140, 165/152, 153, 172–175
See application file for complete search history.

(56) References Cited

U.S. PATENT DOCUMENTS 2,037,845 A * 4/1936 Young ..... 165/139
2,505,790 A * 5/1950 Panthofer ..... 165/140
6,394,176 B1 5/2002 Marsais
2001/0029748 A1* 10/2001 Burk et al. ..... 62/498
2004/0216863 A1* 11/2004 Hu ..... 165/110
2005/0006068 A1* 1/2005 Desai et al. ..... 165/140
2005/0006080 A1* 1/2005 Kamiyama et al. ..... 165/174
2005/0016716 A1* 1/2005 Hu et al. ..... 165/110
2005/0217831 A1* 10/2005 Manaka ..... 165/140
2005/0257921 A1* 11/2005 Hu ..... 165/140
2006/0113068 A1* 6/2006 Desai et al. ..... 165/140

* cited by examiner

*Primary Examiner*—Teresa J. Walberg
(74) *Attorney, Agent, or Firm*—Harness, Dickey & Pierce, PLC

(57) ABSTRACT

A combination cooler includes a first circuit having a first series of tubes defining a first hydraulic diameter. The first fluid circuit is adapted to communicate a first fluid from a first inlet to a first outlet. A second fluid circuit includes a second series of tubes defining a second hydraulic diameter and a third series of tubes defining a third hydraulic diameter. The second fluid circuit is adapted to communicate a second fluid from a second inlet to a second outlet. The first and second hydraulic diameters are equivalent. The third hydraulic diameter is distinct from the first and second hydraulic diameter.

20 Claims, 2 Drawing Sheets

VARIABLE OIL COOLER TUBE SIZE FOR COMBO COOLER

FIELD OF THE INVENTION

The present invention relates to cooling systems in vehicles and more particularly to a combination cooler having a condenser and an oil cooler.

BACKGROUND OF THE INVENTION

A combination cooler includes a condenser and an oil cooler integrated into one heat exchanger assembly. The condenser is part of the air conditioning system and performs heat exchange from a refrigerant to the outside air. The oil cooler is part of another circuit that performs heat exchange from oil, such as automatic transmission fluid, to the outside air. The purpose of the combination cooler is to reduce weight, packaging space and cost.

Due to different fluid physical properties, the ideal tube design is different for each fluid. Considering separate components, the condenser uses smaller tubes with smaller hydraulic diameter relative to the oil cooler tubes. To keep the pressure drop low, the oil cooler uses larger tubes with a larger hydraulic diameter due to higher viscosity compared with refrigerant. Typically a disadvantage of larger tubes is lower heat transfer performance per constant internal fluid flow, as airside surface area is reduced per fixed packaging space.

In one combination cooler design, the condenser region and the oil cooler region use two distinct core configurations. Such a configuration allows specialized tube design for each region to achieve maximum performance. Possible disadvantages may include complex core design and limited oil cooler flexibility and performance.

In another combination cooler design, the condenser and oil cooler are designed to use a common core structure. The advantages are simpler core assembly utilizing common tube and fins. A possible disadvantage however is that an optimal tube diameter for refrigerant through the condenser region is different than an optimal tube diameter for oil through the oil cooler.

SUMMARY OF THE INVENTION

A combination cooler includes a first circuit having a first series of tubes defining a first hydraulic diameter. The first fluid circuit is adapted to communicate a first fluid from a first inlet to a first outlet. A second fluid circuit includes a second series of tubes defining a second hydraulic diameter and a third series of tubes defining a third hydraulic diameter. The second fluid circuit is adapted to communicate a second fluid from a second inlet to a second outlet. The first and second hydraulic diameters are equivalent. The third hydraulic diameter is distinct from the first and second hydraulic diameter.

According to additional features, the first, second and third series of tubes define a plurality of fins. The first series of tubes are arranged adjacent the second series of tubes. A first inlet header is adapted to accept the first fluid and communicate the first fluid to the first series of tubes. A first outlet header is adapted to accept the first fluid from the first series of tubes. A second inlet header is adapted to accept the second fluid and communicate the second fluid to the third series of tubes. A second outlet header is adapted to accept the second fluid from the second series of tubes.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
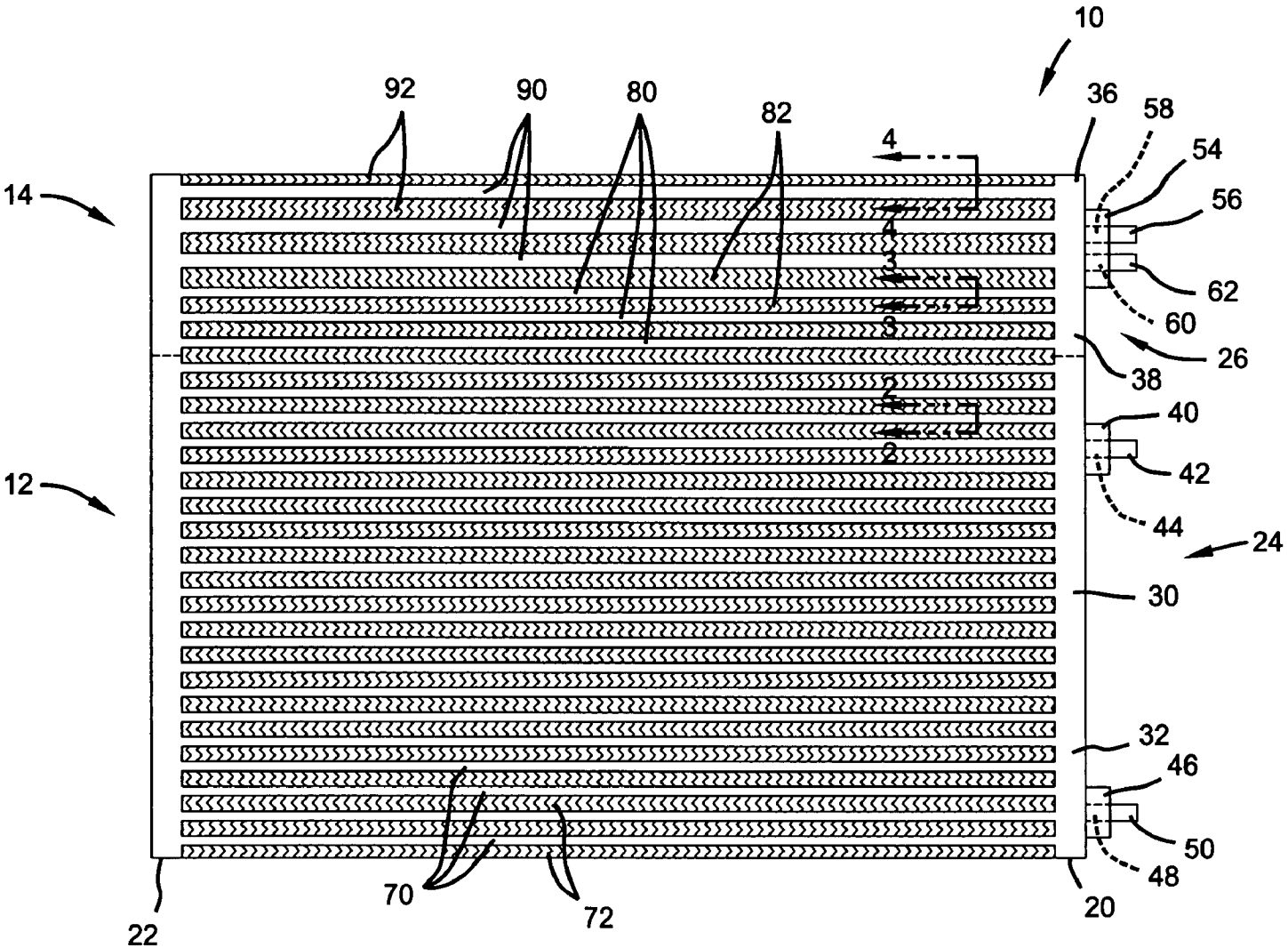
FIG. 1 is a front view of a combination cooler according to the present teachings.
Figure 2:
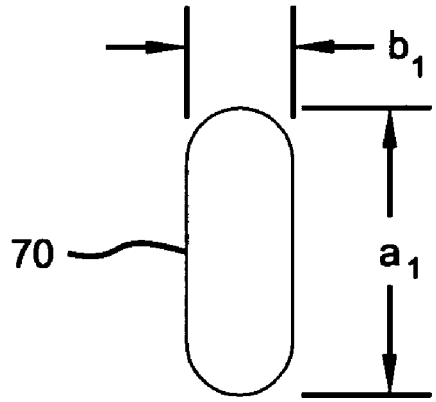
FIG. 2 is a cross-sectional view of a tube of a first series of tubes provided on a condenser portion of the combination cooler.

With initial reference to FIGS. 1 and 2, a combination cooler is shown and generally identified at reference 10. The combination cooler 10 includes a condenser 12 and an oil cooler 14. The condenser 12 is part of an air conditioning system and performs heat exchange from refrigerant to the outside air. The oil cooler 14 is part of another circuit that performs heat exchange from oil, such as automatic transmission fluid, to the outside air. While the exemplary combination cooler 10 is explained herein as performing heat exchange for refrigerant of an air conditioning system and oil of an automatic transmission, it is appreciated, that the teachings may be applied to combination coolers or condensers adapted to provide heat exchange for other fluids.

The combination cooler 10 includes a first header portion 20 and a second header portion 22. The first header portion 20 defines a condenser portion 24 and an oil cooler portion 26. The condenser portion 24 includes a condenser inlet header 30 and a condenser outlet header 32. Similarly, the oil cooler portion 26 includes an oil cooler inlet header 36 and an oil cooler outlet header 38.

The condenser inlet header 30 provides a condenser inlet block 40 having an inlet 42 for receiving refrigerant and a passage 44 for communicating refrigerant to the condenser inlet header 30. The condenser outlet header 32 provides a condenser outlet block 46 having a passage 48 for communicating refrigerant from the condenser outlet header 32 to an outlet 50 defined on the condenser outlet block 46.

The oil cooler inlet header 36 provides an oil cooler block 54 having an inlet 56 for receiving oil and a passage 58 for communicating oil to the oil cooler inlet header 36. The oil cooler block 54 also provides a passage 60 for communicating oil from the oil cooler outlet header 38 to an outlet 62 defined on the oil cooler block 54.

In a refrigeration cycle, a compressor (not shown) discharges a superheated gas refrigerant of high temperature and high pressure, which flows into the condenser 12 at the inlet 42 provided on the condenser inlet block 40. From the passage 44, the refrigerant enters the condenser inlet header 30. The condenser inlet header 30 distributes refrigerant to a first series of tubes 70 extending from the condenser inlet header 30 to the condenser outlet header 32. Here, heat exchange is performed with the outside air sent by a cooling fan (not shown), so that the refrigerant is cooled and condensed.

The first series of tubes 70 provided on the condenser 12 extend between the first header 20 and the second header 22. More specifically, the condenser 12 defines twenty tubes each having the same dimensions (as will be described in greater detail) and extending between the first header 20 and the second header 22. The condenser 12 is configured such that half of the first series of tubes 70 carry refrigerant from the condenser inlet header 30 to the second header 22 (from right to left as viewed in FIG. 1). Refrigerant then flows from the second header 22 back to the condenser outlet header 32 (from left to right as viewed in FIG. 1). Each tube 70 includes a plurality of fins 72 arranged thereon to facilitate heat transfer as the refrigerant flows between the respective headers 20 and 22. It is appreciated that the fins 72 are exemplary and may be configured differently.

It is appreciated that the condenser 12 may be configured differently. For example, an alternate number of tubes 70 may be provided. In addition, while the exemplary condenser 12 has been described as providing a fluid communication circuit making two passes across the length of the condenser 12 (from the first header 20, to the second header 22 and back to the first header 20), the fluid communication circuit may be configured to make a single pass, or three, four or more passes across the condenser 12. Likewise, the condenser inlet and outlet blocks 40 and 46 may be arranged differently on the condenser 12.

The tubes provided on the oil cooler comprise a second and third series of tubes 80 and 90, respectively. The second and third series of tubes 80 and 90 extend between the first header 20 and the second header 22. More specifically, the exemplary oil cooler 14 defines six tubes. The six tubes include three tubes (the second series of tubes 80) having a first dimension and three tubes (the third series of tubes 90) having a second dimension (as will be described in greater detail). The second and third series of tubes 80 and 90 include fins 82 and 92, respectively, arranged thereon to facilitate heat transfer as the oil flows between the respective headers 20 and 22. It is appreciated that the fins 82 and 92 are exemplary and may be configured differently.

The oil cooler 14 is configured such that half of the tubes (the third series of tubes 90) carry refrigerant from the oil cooler inlet header 36 to the second header 22 (from right to left as viewed in FIG. 1). Oil then flows from the second header 22, through the second series of tubes 80 and 90, and back to the oil cooler outlet header 38 (from left to right as viewed in FIG. 1).

It is appreciated that the oil cooler 14 may be configured differently. For example, an alternate number of tubes 80, 90 may be provided. Moreover, while an equivalent amount of second and third series of tubes 80 and 90 have been described as carrying oil between the respective first and second headers, 20 and 22, a distinct amount of tubes 80, 90 may be employed. For example, four tubes may be configured to carry oil from the first header 20 to the second header 22 and two tubes may be configured to carry oil from the second header 22 back to the first header 20. In addition, while the exemplary oil cooler 14 has been described as providing a fluid communication circuit making two passes across the length of the oil cooler 14 (from the first header 20, to the second header 22 and back to the first header 20), the fluid communication circuit may be configured to make a single pass, or three, four or more passes across the oil cooler 14. Likewise, the oil cooler block 54 may be arranged differently on the oil cooler 14 or may comprise a unique oil cooler inlet block and oil cooler outlet block.

Figure 3:
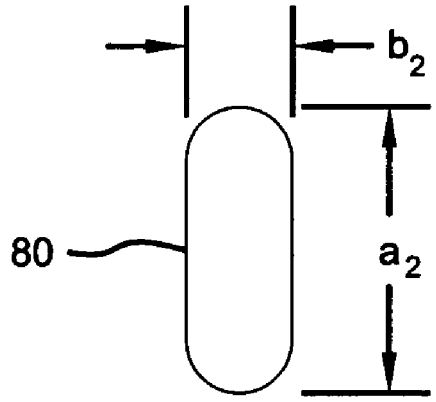
FIG. 3 is a cross-sectional view of a tube of a second series of tubes of the combination cooler provided on an oil cooler.
Figure 4:
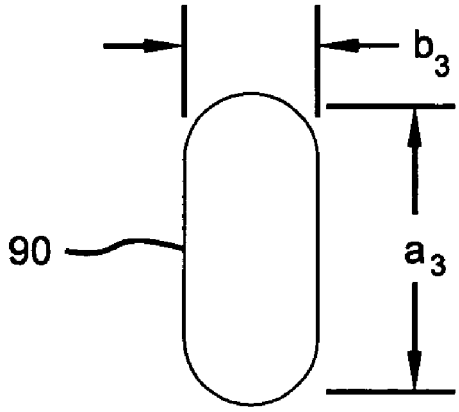
FIG. 4 is a cross-sectional view of a tube of a third series of tubes of the combination cooler provided on the oil cooler.

Turning now to FIGS. 2–4, the cross-sections of the tubes 70, 80 and 90 are shown. As used herein, the term cross-section is used to refer to an inner area defined in a given tube that is adapted to pass fluid. As illustrated, each tube 70, 80 and 90 defines an oblong geometry. For purposes of discussion, each tube defines a cross-sectional area for communicating fluid. Each tube 70, 80 and 90 defines a height $a_1$, $a_2$, and $a_3$, and a width $b_1$, $b_2$, and $b_3$, respectively. It is appreciated, that each tube 70, 80 and 90 may include one or a series of support members (not shown) extending between an inner dimension. Those skilled in the art will appreciate that the tubes 70, 80 and 90 may be formed in many geometries such as circular, rectangular, elliptical, oblong and others. In general, a hydraulic diameter, represented as $d_h$, may be used to characterize an equivalent geometrical diameter for channels of non-circular shape. Hydraulic diameter $d_h$ may be represented by the following mathematical relationship.

$$d_h = \frac{4(\text{cross-sectional area})}{\text{wetted perimeter}}$$

The combination cooler 10 according to the present teachings provides a condenser 12 having the first series of tubes 70 defining a first hydraulic diameter (FIG. 2). The combination cooler 10 also provides an oil cooler 14 having the second series of tubes 80 defining a second hydraulic diameter (FIG. 3) and the third series of tubes 90 defining a third hydraulic diameter (FIG. 4). The tubes 70 of the condenser 12 having the first hydraulic diameter and the tubes 80 having the second hydraulic diameter are equivalent. Or, more specifically, $a_1=a_2$ and $b_1=b_2$. The tubes 90 of the oil cooler 14 have a larger hydraulic diameter than the condenser tubes 70 and the second series of tubes 80 of the oil cooler 14. As represented in FIGS. 2–4, $b_3$ is greater than $b_1$ and $b_2$. In the exemplary configuration, $a_1=a_2=a_3$. It is appreciated however, that the tubes 90 having a larger hydraulic diameter may define other dimensions for $a_3$ and $b_3$ while still defining a larger hydraulic diameter. It is also appreciated that while the exemplary tubes 70, 80 and 90 are shown as having an oblong cross-section they may alternatively have other cross-sections such as but not limited to, circular and rectangular. In sum, the tubes 90 (FIG. 4) define a larger cross-sectional area than the tubes 70 and 80. Those skilled in the art will appreciate that the second series of tubes 80 may also define some tubes having the same cross-section as the tubes 70 and others having a larger cross-section (such as illustrated in FIG. 4). Likewise, the third series of tubes may also define some tubes having the same cross-section as the tubes 70 and others having a larger cross-section (FIG. 4).

It is appreciated that the cross-sectional area or hydraulic diameter may be modified to account for any support members provided within the respective tubes 70, 80 and 90. In general, as the cross-sectional area of a tube increases, the pressure drop and the heat transfer properties of the tube decrease. As a result, the pressure drop of the oil cooler 14 may be lowered and consequently optimized by providing a desired amount of the third series of tubes 90 for any given application. Utilizing the same dimension of tube for the first and second series of tubes 70 and 80 minimizes tooling and assembly expense.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A combination cooler comprising:

a first fluid circuit having a first series of tubes defining a first hydraulic diameter, said first fluid circuit adapted to communicate a first fluid from a first inlet to a first outlet;

a second fluid circuit having a second series of tubes defining a second hydraulic diameter and a third series of tubes defining a third hydraulic diameter, said second fluid circuit adapted to communicate a second fluid from a second inlet to a second outlet; and wherein said first and second hydraulic diameter are equivalent and said third hydraulic diameter is distinct from said first and second hydraulic diameter, wherein said third hydraulic diameter is located in at least a top cross tube to initially minimize a pressure drop of said second fluid relative to said first and second series of tubes.

2. The combination cooler of claim 1 wherein said first, second and third series of tubes define a plurality of fins thereon.

3. The combination cooler of claim 2 wherein said first series of tubes are arranged adjacent said second series of tubes.

4. The combination cooler of claim 3, further comprising a first inlet header adapted to accept said first fluid and communicate said first fluid to said first series of tubes.

5. The combination cooler of claim 4, further comprising a first outlet header adapted to accept said first fluid from said first series of tubes.

6. The combination cooler of claim 5, further comprising a second inlet header adapted to accept said second fluid and communicate said second fluid to said third series of tubes.

7. The combination cooler of claim 6, further comprising a second outlet header adapted to accept said second fluid from said second series of tubes.

8. The combination cooler of claim 3 wherein said third hydraulic diameter is greater than said first and second hydraulic diameter.

9. The combination cooler of claim 8 wherein said first fluid is refrigerant and said second fluid is oil.

10. A combination cooler comprising:

a first fluid circuit having a first series of tubes defining a first cross-section, said first fluid circuit adapted to communicate a first fluid from a first inlet to a first outlet;

a second fluid circuit having a second series of tubes defining a second cross-section and a third series of tubes defining a third cross-section, said second fluid circuit adapted to communicate a second fluid from a second inlet to a second outlet; and wherein said first and second cross-sections are equivalent and said third cross-section is distinct from said first and second cross-sections, wherein said third cross-section is located in at least a top cross tube to minimize a pressure drop of said second fluid within said at least a top cross tube of said third series of tubes relative to said first and second series of tubes.

11. The combination cooler of claim 10 wherein said first, second and third series of tubes define a plurality of fins thereon.

12. The combination cooler of claim 11 wherein said first series of tubes are arranged adjacent said second series of tubes.

13. The combination cooler of claim 12, further comprising a first inlet header adapted to accept said first fluid and communicate said first fluid to said first series of tubes.

14. The combination cooler of claim 13, further comprising a first outlet header adapted to accept said first fluid from said first series of tubes.

15. The combination cooler of claim 14, further comprising a second inlet header adapted to accept said second fluid and communicate said second fluid to said third series of tubes.

16. The combination cooler of claim 15, further comprising a second outlet header adapted to accept said second fluid from said second series of tubes.

17. The combination cooler of claim 16 wherein a quantity of said second series of tubes is equivalent to a quantity of said third series of tubes.

18. The combination cooler of claim 13 wherein said third hydraulic diameter is greater than said first and second hydraulic diameter.

19. The combination cooler of claim 18 wherein said first fluid is refrigerant and said second fluid is oil.

20. A combination cooler comprising:

a first fluid circuit having a first series of tubes defining a first cross-section, said first fluid circuit adapted to communicate a refrigerant from a first inlet, through said first series of tubes, to a first outlet; and a second fluid circuit having a second series of tubes defining a second cross-section and a third series of tubes defining a third cross-section, said second fluid circuit adapted to communicate a second fluid from a second inlet, through said second and third series of tubes and to a second outlet;

wherein said first and second cross-section are equivalent and said third cross-section is greater than said first and second cross-section, and wherein said third cross-section is located in more than one top cross tube of the combination cooler to minimize a pressure drop, of said second fluid within said more than one top cross tube of said third series of tubes relative to said first and second series of tubes, before said second fluid passes into said second cross-section.

* * * * *